United States Patent [19]

Oguri et al.

[11] Patent Number: 4,699,039

[45] Date of Patent: Oct. 13, 1987

[54] AUTOMATIC MUSICAL ACCOMPANIMENT PLAYING SYSTEM

[75] Inventors: Shigenori Oguri; Akira Iizuka, both of Hamamatsu, Japan

[73] Assignee: Nippon Gakki Seizo Kabushiki Kaisha, Hamamatsu, Japan

[21] Appl. No.: 899,391

[22] Filed: Aug. 22, 1986

[30] Foreign Application Priority Data

Aug. 26, 1985 [JP] Japan ..... 60-128843[U]
Dec. 10, 1985 [JP] Japan ..... 60-275927

[51] Int. Cl.[4] ..... G10H 1/06; G10H 1/42; G10H 7/00

[52] U.S. Cl. ..... 84/1.03; 84/1.19; 84/DIG. 12; 84/DIG. 22

[58] Field of Search ..... 84/1.01, 1.03, 1.11–1.13, 84/1.17, 1.19–1.27, DIG. 12, DIG. 22

[56] References Cited

U.S. PATENT DOCUMENTS

| | | | |
|---|---|---|---|
| 3,882,751 | 5/1975 | Tomisawa et al. | 84/1.01 |
| 4,417,494 | 11/1983 | Nakada et al. | 84/1.03 |
| 4,433,601 | 2/1984 | Hall et al. | 84/1.03 |
| 4,476,766 | 10/1984 | Ishii | 84/1.03 |
| 4,624,170 | 11/1986 | Ohno et al. | 84/1.03 |

*Primary Examiner*—S. J. Witkowski

*Attorney, Agent, or Firm*—Spensley Horn Jubas & Lubitz

[57] ABSTRACT

An automatic musical accompaniment playing system for use in an electronic musical instrument with an auto rhythm system changes a tone color of accompaniment tones when the state of operation of the auto rhythm system is changed. The automatic accompaniment playing system comprises a tempo clock generator for generating tempo clock pulses having a frequency proportional to a tempo of a rhythm to be generated and a register for storing a flag indicative of a state of operation of the auto rhythm system. The tempo clock pulses are counted by a tempo counter when the auto rhythm system is in operation, and the state of operation of the auto rhythm system is detected in accordance with the state of the flag. A memory stores two groups of tone color data, one of which is selected when the auto rhythm system is in operation, and the other of which is selected when the auto rhythm system is not in operation. One of the tone color data in the selected group is read from the memory in accordance with an output of a tone color selection switch. A tone signal generating circuit generates tones of a chord inputted through a keyboard in accordance with a count value of the tempo counter in a tone color designated by the read tone color data.

7 Claims, 13 Drawing Figures

AUTOMATIC MUSICAL ACCOMPANIMENT PLAYING SYSTEM

BACKGROUND OF THE INVENTION

1. Field of the Invention

This invention relates to an automatic musical accompaniment playing system for use in an electronic musical instrument which can automatically play an accompaniment such as a rhythmic chord and a melodic chord (an arpeggio).

2. Prior Art

There has been proposed an electronic musical instrument which has an automatic musical accompaniment playing system capable of automatically playing an accompaniment such as a rhythmic chord and a melodic chord (an arpeggio) based on a chord determined by a depressed key or keys on a keyboard. The rhythmic chord is played by intermittently generating all constituent tones of the determined chord at timing determined by a selected rhythm, as shown, for example, in FIG. 1. The melodic chord is played by selectively generating one or more constituent tones of the chord in the order determined by a selected rhythm, as shown, for example, in FIG. 2.

Such automatic accompaniment system generally operates in synchronization with an an auto rhythm system incorporated in the electronic musical instrument, as disclosed, for example, in U.S. Pat. No. 4,433,601. The generation of rhythm pattern is controlled by the performer, and the start and stop of operation of the auto rhythm system is also controlled by the performer. With the conventional automatic accompaniment system, however, a tone color (i.e., a voice or a timbre) of the accompaniment has not been changed in eesponse to such change of operation of the auto rhythm system, so that it has been possible that the accompaniment is produced in a tone color not suitable to the rhythm pattern generated by the auto rhythm system. To avoid this, it is necessary to provide a tone color selection switch and a tone signal source for the accompaniment, which however increases the manufacturing costs.

FIG. 3 shows a performer's panel of one conventional electronic musical instrument. With this electronic musical instrument, the performer first selects a rhythm through a rhythm selection switch (not shown), and subsequently selects one of piano, electric piano, jazz guitar, solid guitar and brass tones by depressing a corresponding one of the buttons for special preset which are shown at the center of FIG. 3. Then, the performer selects the rhythmic chord by depressing a button indicated by "rhythmic chord". FIG. 4 shows a performer's panel of another conventional electronic musical instrument. With this electronic musical instrument, the performer first selects a rhythm through a rhythm selection switch (not shown), and subsequently selects a tone color with respect to each of two rhythm patterns corresponding to the selected rhythm. More specifically, two rhythm patterns can be simultaneously generated in this electronic musical instrument, and one of piano, jazz guitar, solid guitar and phaser tones is selected for one of the two rhythm patterns, and one of brass, jazz guitar, solid guitar and phaser tones is selected for the other of the two rhythm patterns.

Thus, with the automatic accompaniment playing systems of he conventional electronic musical instruments, a tone color of tones of an accompaniment to be produced has been determined irrespectively of the type of the accompaniment (i.e., irrespectively of whether the accompaniment chord is a rhythmic chord or a melodic chord (an arpeggio)). It is, however, desirable to change the tone color in accordance with the type of the accompaniment.

SUMMARY OF THE INVENTION

It is therefore an object of the present invention to provide an automatic accompaniment playing system for use in an electronic musical instrument in which a tone color of tones of an accompaniment is changed in accordance with the state of operation of an auto rhythm system incorporated in the electronic musical instrument.

Another object of the invention is to provide such an automatic accompaniment system in which a tone color of tones of an accompaniment is determined not only in accordance with a selected rhythm but also in accordance with the type of the accompaniment.

According to a first aspect of the present invention, there is provided an automatic musical accompaniment playing system for use in an electronic musical instrument having an auto rhythm system comprising a tempo clock generator for generating clock pulses having a frequency proportional to a tempo of a rhythm to be generated by the auto rhythm system; register means for storing state information indicative of a state of operation of the auto rhythm system; counter means for counting the clock pulses in accordance with the state information; tone color selecting means for selecting one of a plurality of tone colors; detecting means for detecting a change of the operation of the tempo counter means in accordance with the state information to output a change detection signal; tone color data generating means responsive to the selected tone color for generating as an output thereof first tone color data corresponding to the selected tone color when the detection signal is not outputted from the detecting means, the tone color data generating means generating as the output second tone color data corresponding to the selected tone color and different from the first tone color data in response to the change detection signal; and tone generating means operatively connected to the counter means for generating accompaniment tones having a tone color represented by the output from the tone color data generating means at timing based on a count value of the counter means; whereby the tone color of the accompaniment tones is changed in accordance with the state of operation of the counter means.

According to a second aspect of the present invention, there is provided an automatic musical accompaniment playing system for use in an electronic musical instrument comprising a tempo clock generator for generating clock pulses having a frequency proportional to a tempo of a rhythm to be generated; counter means for counting the clock pulses; rhythm selection means for selecting one of plural rhythms to output rhythm data representative of the selected rhythm; rhythm pattern generating means responsive to the rhythm data for generating a rhythm pattern corresponding to the selected rhythm in accordance with a count value of the counter means; rhythm tone generating means for generating rhythm tones at timing determined by the rhythm pattern; accompaniment type selection means for selecting one of plural types of accompaniments to output type data representative of the selected accompaniment type; accompaniment pattern generating means responsive to the type data for generating an accompaniment pattern in accordance with the count value of the counter means; accompaniment tone data generating means responsive to the accompaniment pattern for generating accompaniment tone data representative of accompaniment tones; tone color data generating means for generating tone color data representative of a tone color determined by the rhythm data and the type data, the tone color being suitable for the selected rhythm and the selected accompaniment type; accompaniment tone generating means responsive to the accompaniment tone data for generating the accompaniment tones having the tone color at timing determined by the accompaniment pattern; and mixing means for mixing the accompaniment tones with the rhythm tones as an output of the automatic accompaniment playing system.

DESCRIPTION OF THE PREFERRED EMBODIMENTS OF THE INVENTION

Figure 5:
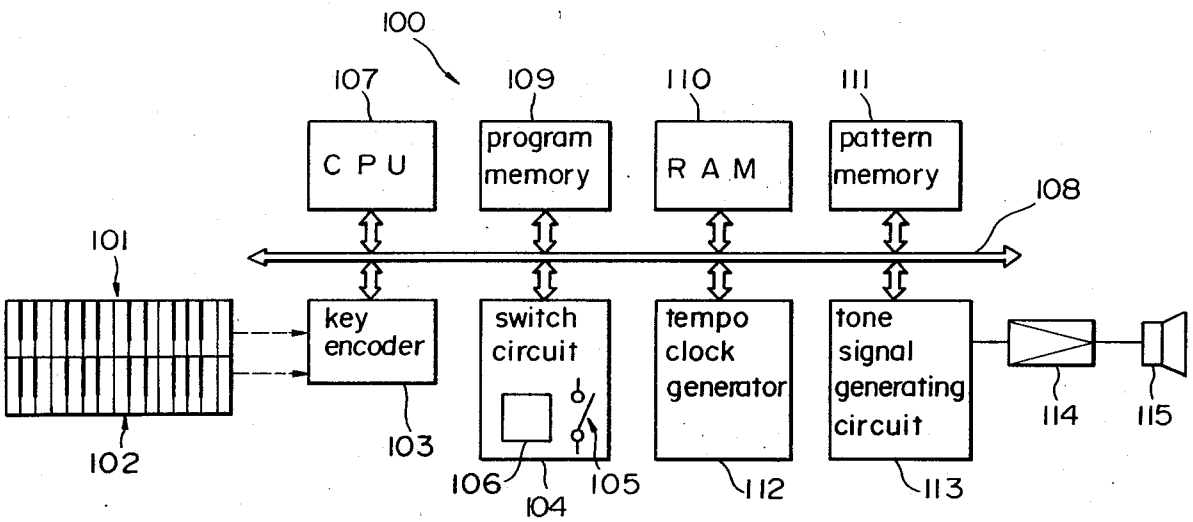
FIG. 5 is a block diagram of an electronic musical instrument comprising an automatic musical accompaniment playing system provided in accordance with a first embodiment of the invention.

Referring now to FIG. 5, there is shown an electronic musical instrument 100 comprising an automatic musical accompaniment playing system provided in accordance with a first embodiment of the present invention. The electronic musical instrument 100 comprises an upper keyboard (melody keyboard) 101 and a lower keyboard (harmony keyboard) 102, both of which are electrically connected to key encoder 103 which detects each depression of key on the upper and lower keyboards 101 and 102 and produces key information including a key code representative of each depressed key. The upper and lower keyboards 101 and 102 can be replaced by a single keyboard, in which case the upper key zone of the keyboard is used for playing a melody and the lower key zone is used for playing an accompaniment to the melody. Shown at 104 is a switch circuit which includes a rhythm start/stop switch 105 for controlling start and stop of an auto rhythm system provided in this instrument 100 and a tone color selection switch 106. The auto rhythm system produces a rhythm sound of one of a plurality of different rhythm patterns selected by a rhythm selection switch (not shown) provided on a console of this electronic musical instrument 100.

Figure 6:
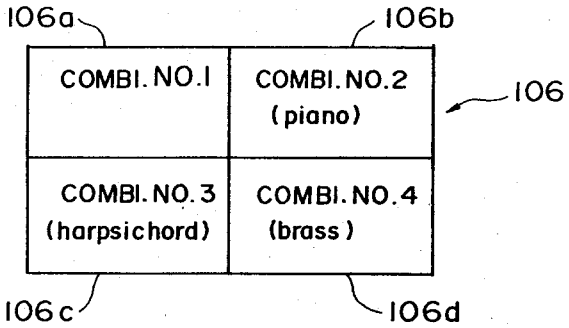
FIG. 6 is an illustration showing a tone color selection switch 106 of the electronic musical instrument of FIG. 5.

As shown in FIG. 6, the tone color selection switch 106 comprises four push-button type switches **106*a* to 106*d*. In a normal playing mode, the switches 106*a* to 106*d* are used to designate a tone color (i.e., a voice or a timbre) of tones generated in accordance with depression of keys on the harmony keyboard 102. More specifically, in the normal playing mode in which the auto-rhythm system is not running, tones corresponding to keys depressed on the harmony keyboard 102 are generated in one of four tone colors, namely Combination No. 1, Combination No. 2, Combination No. 3 and Combination No. 4. Each of the above four tone colors is determined by the performer by combining various tone colors through switches and volumes on the console of this instrument 100**.

In an automatic playing mode, the switches **106*b* to 106*d* are used to select one of three tone colors parenthesized in FIG. 6. More specifically, the switches 106*b*, 106*c* and 106*d* designate a piano tone, a harpsichord tone and a brass tone, respectively, in the automatic playing mode wherein the auto rhythm system is running. When the switch 106*a* is depressed, tones corresponding to keys depressed on the harmonic keyboard 102 are produced in the tone color corresponding to Combination No. 1 irrespectively of whether the instrument 100** is in the automatic playing mode or in the normal playing mode.

The key encoder 103 and the switch circuit 104 are connected to a central processing unit (CPU) 107 through a bidirectional signal bus 108. The CPU 107 controls most of portions of this instrument 100 in accordance with programs stored in a program memory 109 composed of a ROM. The CPU 107 is also connected through the signal bus 108 to a RAM 110 providing a working area for storing various temporary data, a pattern memory 111 storing various pattern data, a tempo clock generator 112 for generating a tempo clock signal and a tone signal generating circuit 113. The CPU 107 reads the key codes outputted from the key encoder 103 and data representative of states of the switches from the switch circuit 104; performs data processing to produce musical information such as data representative of beginning of generation of a tone, data representative of end of generation of a tone, data representative of a pitch of a tone and data representative of a tone color of a tone; and outputs the musical information to the tone signal generating circuit 113. The tone signal generating circuit 113 comprises a plurality of tone signal generating channels each for generating a tone signal.

The RAM 110 provides therein various flags, registers and buffers described hereunder:

Rhythm run flag RHY

Figure 7:
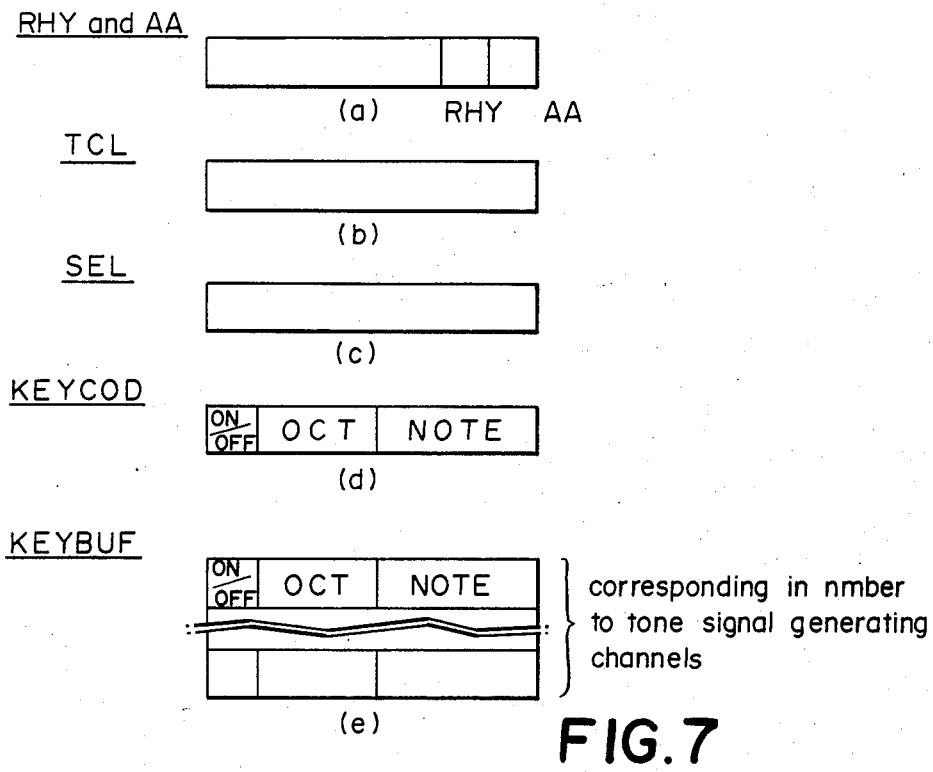
FIG. 7 is an illustration showing flags and buffers provided in the RAM 110 of the electronic musical instrument of FIG. 5.

This rhythm flag RHY is set to "1" by the CPU 107 when the rhythm start/stop switch 105 is closed to run the auto rhythm system, and is reset to "0" when the switch 105 is open (FIG. 7-(*a*)).

Automatic accompaniment flag AA

This flag AA is set to "1" when a musical accompaniment is automatically played, and is reset to "0" when a musical accompaniment is not automatically played (FIG. 7-(*a*)).

Tempo counter TCL

This counter TCL counts pulses of the tempo clock signal outputted from the tempo clock generator 112 within a range of from "0" to "63" (FIG. 7-(*b*)). The contents of this counter TCL represent the current time within a rhythm pattern, for example, of two measures.

Tone color switch reqister SEL

This register SEL is loaded, by the CPU 107, with one of four data "1" to "4" respectively representing the tone color selection switches 106*a* to 106*d* (FIG. 7-(*c*)).

Key code buffer KEYCOD

This one-byte buffer KEYCOD stores a key code, which is fed from the key encoder 103 in response to a manipulation of a key (or an event on the keyboard 102), and one-bit data representative of the kind of the event, as shown in FIG. 7-(*d*). More specifically, the most significant bit (MSB) of the buffer KEYCOD stores a key ON/OFF bit representative of whether the event is a depression (or ON) of key or a release (or OFF) of key. The remaining seven bits of the buffer KEYCOD store the key code of the manipulated key. In this case, the key code contains at its higher-order three bits an octave code OCT representative of the key zone to which the key represented by the key code belongs, and also contains at its lower-order three bits a note code NOTE representative of the note name of the key represented by the key code. The note code takes a value of from "0" to "11" which correspond respectively to note names C, C#, . . . , A# and B.

Key buffer KEYBUF

This key buffer KEYBUF stores key codes representative respectively of keys which are in the depressed state. As shown in FIG. 7-(*e*), each of the key codes is stored in this buffer KEYBUF in the same format as that stored in the buffer KEYCOD. The number of areas or bytes of this buffer KEYBUF is the same as the number of tone signal generating channels of the tone signal generating circuit 113.

The pattern memory 111 comprises a ROM in which a pattern table PTBL, a voice table VOICETBL and other necessary tables are stored.

Figure 8:
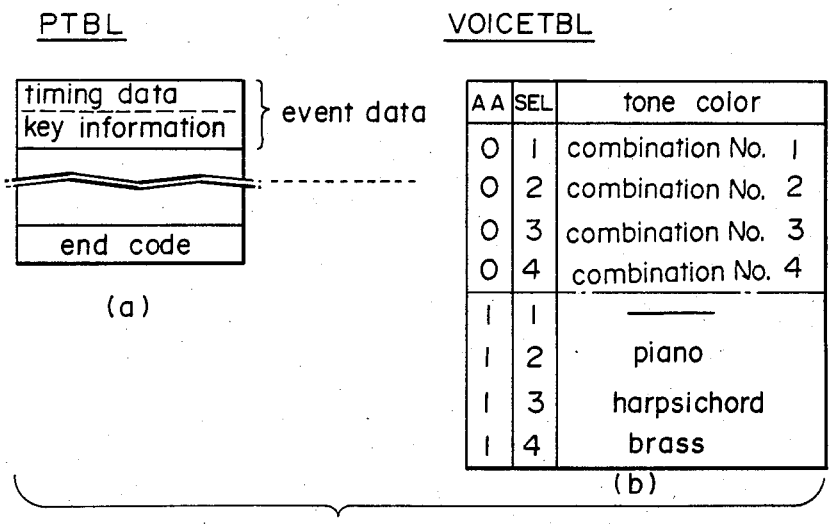
FIG. 8 is an illustration showing tables provided in the pattern memory 111 of the electronic musical instrument of FIG. 5.

The pattern table PTBL stores, with respect to each of the plurality of tone signal generating channels of the tone signal generating circuit 113, accompaniment patterns equal in number to the product of the number of the rhythm patterns available and the number of chord types. As shown in FIG. 8-(*a*), each of the accompaniment patterns includes a predetermined number of event data and an end code indicative of the end of the table. Each of the event data includes key information representative of a tone to be generated (for example, an interval from the root note) and data representative of timing of generation of the tone. The timing data takes a value between "0" and "63", and the generation of the tone is initiated when the contents of the tempo counter TCL coincide with this value.

The voice table VOICETBL is a data table for determining a tone color of a tone to be generated in accordance with a combination of the data in the tone color switch register SEL and the state of the automatic accompaniment flag AA, as shown in FIG. 8-(*b*). It will be appreciated from FIG. 8-(*b*) that the tone color corresponding to Combination No. 3 is selected when the automatic accompaniment flag AA is "0" and when the data in the tone color switch register SEL is "3". It is also appreciated that the piano tone is selected when the automatic accompaniment flag AA is "1" and when the data in the tone color switch register SEL is "2".

The tempo clock generator 112 comprises a variable frequency type oscillator and a frequency divider of a variable division-rate type (not shown) for dividing the frequency of the output of the oscillator to produce the tempo clock signal. The period of the tempo clock signal can be changed by manipulating knobs connected to the oscillator and the frequency divider, and is set, for example, to one eighth of one beat (or a quarter note).

The plurality of tone signal generating channels of the tone signal generating circuit 113 are divided into two groups for respectively generating tones of a melody and tones of an accompaniment. The tone signal generating circuit 113 thus forms musical tone signals (chord tone signals, base tone signals and melody tone signals) in accordance with the musical information supplied from the CPU 107. The musical tone signals are amplified by an amplifier 114 and outputted from a loudspeaker 115 as a musical sound.

The operation of the electronic musical instrument 100 will now be described with reference to flow charts of FIGS. 9 to 12.

(1) Main processing

Figure 9:
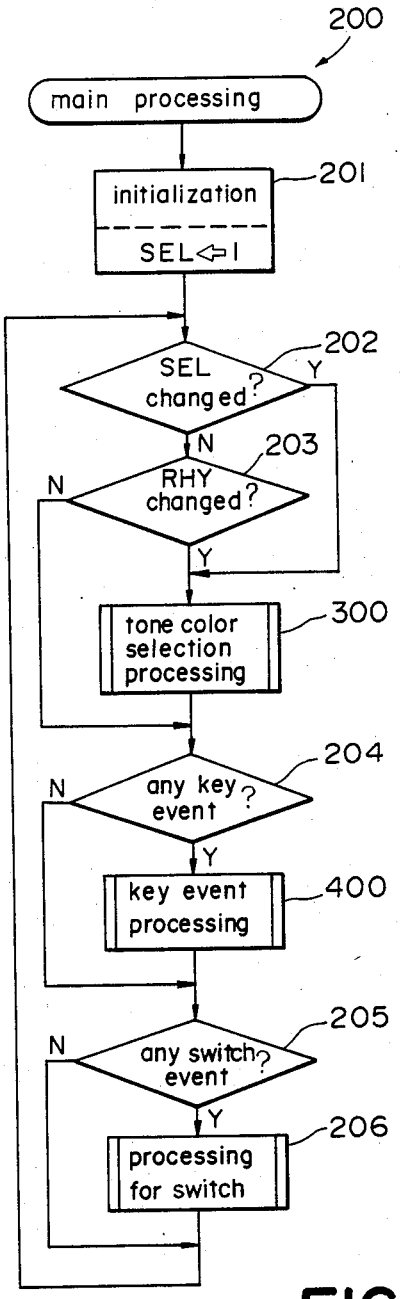
FIG. 9 is a flow chart of the main processing performed by the CPU 107 of the electronic musical instrument of FIG. 5.

When power is supplied to this electronic musical instrument 100, the CPU 107 begins to carry out the processing 200 shown in FIG. 9 in accordance with control programs stored in the program memory 109. At step 201, the CPU 107 executes an initialization routine of the control programs to clear the flags RHY and AA, the tempo counter TCL and the buffers KEYCOD and KEYBUF, stores a "1" into the register SEL, and initializes other circuit portions of this electronic musical instrument 100. Then, the processing proceeds to step 202.

At the step 202, it is determined whether the data contained in the tone color switch register SEL has been changed. If the determination result is "NO", the processing proceeds to step 203. On the other hand, if the determination result is "YES", the processing proceeds to step 300 to carry out a tone color selection processing shown in FIG. 10. At the step 203, it is determined whether the state of the rhythm run flag RHY has been changed. If the determination result is "YES", the processing proceeds to the step 300, otherwise the processing proceeds to step 204. Thus, in any cases other than the case where both of the state of the tone color selection switch 106 and the state of operation of the auto rhythm system have not been changed, the tone color selection processing is carried out at the step 300..

At the step 204, it is determined whether the state of any one of the keys of the keyboard has been changed, that is, whether there has occurred any key event on the keyboard 102. If the determination result is "YES", the processing proceeds to step 400, at which a key event processing is carried out, and thence to step 205. On the other hand, if the determination result is "NO", the processing directly proceeds to the step 205. At the step 205, it is determined whether the state of any one of the rhythm selection switches and other switches on the console of this electronic musical instrument 100 has been changed. If the determination is "YES", the processing proceeds to step 206 to carry out a processing for the switch and then the processing returns to the step 202. On the other hand, if the determination result is "NO", the processing directly returns from the step 205 to the step 202.

(2) Tone color selection processing

Figure 10:
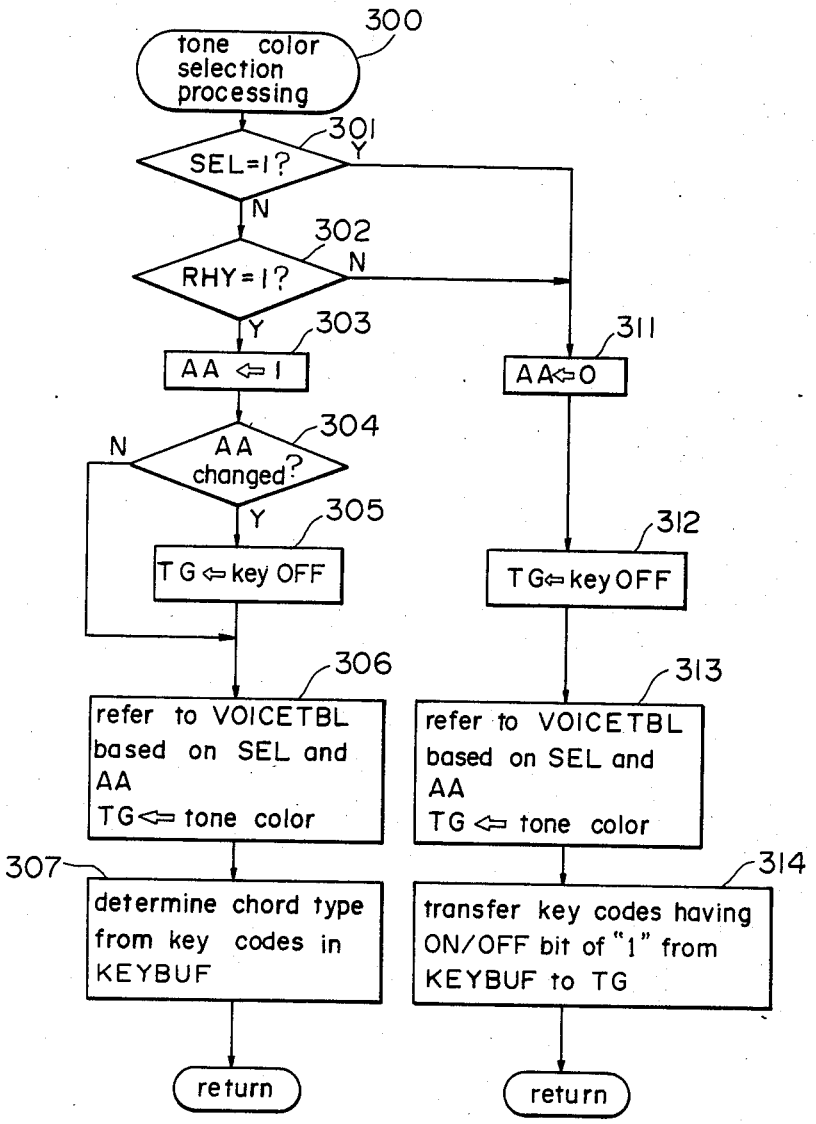
FIG. 10 is a flow chart of the tone color selection processing performed by the CPU 107.

The tone color selection processing to be performed at the step 300 of FIG. 5 will now be more fully described with reference to a flow chart shown in FIG. 10.

At step 301, it is determined whether the data in the tone color switch register SEL is "1", that is, whether the tone color selected by the tone color selection switch 106 is Combination No. 1. If the determination result is "YES", the processing proceeds to step 311. On the other hand, if the determination result is "NO", the processing proceeds to step 302 to further determine whether the rhythm run flag RHY is "1". If the determination result at the step 302 is "YES", that is, if the auto rhythm system is running, the processing proceeds to step 303. On the other hand, if the determination result at the step 302 is "NO", that is, if the auto rhythm system is not running, the processing proceeds to the step 311. At the step 303, the automatic accompaniment flag AA is set to "1". Then, it is determined at the next step 304 whether the state of the automatic accompaniment flag AA has been changed. If the state of the automatic accompaniment flag AA has been change, the CPU 107 outputs at step 305 key information indicating that all the keys for playing an accompaniment are in the OFF state to the tone signal generating circuit 113 (or TG). Then, the processing proceeds to the next step 306. On the other hand, if the state of the automatic accompaniment flag AA has not been changed, the processing directly proceeds from the step 304 to the step 306. At the step 306, the CPU 107 refers to the voice table VOICETBL and selects one of the tone colors in the table based on the state of the automatic accompaniment flag AA and the data in the tone color switch register SEL. The CPU 107 then outputs data representative of the tone color thus selected to the tone signal generating circuit 113 (TG). In this case, the automatic accompaniment flag AA is in the "1" state and the data in the tone color switch register SEL is one of "2" to "4", so that one of the piano, harpsichord and brass tones is selected from the voice table VOICETBL. Thus, the tone signal generating circuit 113 thereafter generates tone signals in the selected tone color. At the next step 307, the CPU 107 determines a chord type of the accompaniment chord to be produced from the key codes corresponding to the depressed keys. Then, the processing returns to the main processing 200 shown in FIG. 5.

At the step 311, the automatic accompaniment flag AA is reset to "0". Then, the processing proceeds to the next step 312 at which the CPU 107 outputs key information indicating that all the keys for playing an accompaniment are in the OFF state to the tone signal generating circuit 113 (TG). The reason why such key OFF information must be outputted to the tone signal generating circuit 113 is that when the auto rhythm system is stopped during the time when accompaniment tones are automatically generated the generation of the accompaniment tones should be ceased and the tones must be generated in the newly selected tone color. Then, the processing proceeds to the next step 313 at which the CPU 107 refers to the voice table VOICETBL and selects one of the tone colors in the table VOICETBL based on the state of the automatic accompaniment flag AA and the data in the tone color switch register SEL. The CPU 107 then outputs data representative of the tone color thus selected to the tone signal generating circuit 113 (TG). In this case, the automatic accompaniment flag AA is in the "0" state and the data in the tone color switch register SEL is one of "1" to "4", so that one of the four tone colors corresponding respectively to Combination Nos. 1 to 4 is selected from the voice table VOICETBL. Thus, the tone signal generating circuit 113 thereafter generates the tone signals with this newly selected tone color. Then, the processing proceeds from the step 313 to the next step 314. At this step 314, the CPU 107 reads the key codes from the bytes of the key buffer KEYBUF whose most significant bits are "1", that is, the key codes of the keys which are in the depressed state, and outputs the read key codes to the tone signal generating circuit 113 to thereby resume the generation of the tones of the depressed keys. Then, the processing returns to the main processing 200.

(3) Key event processing

Figure 11:
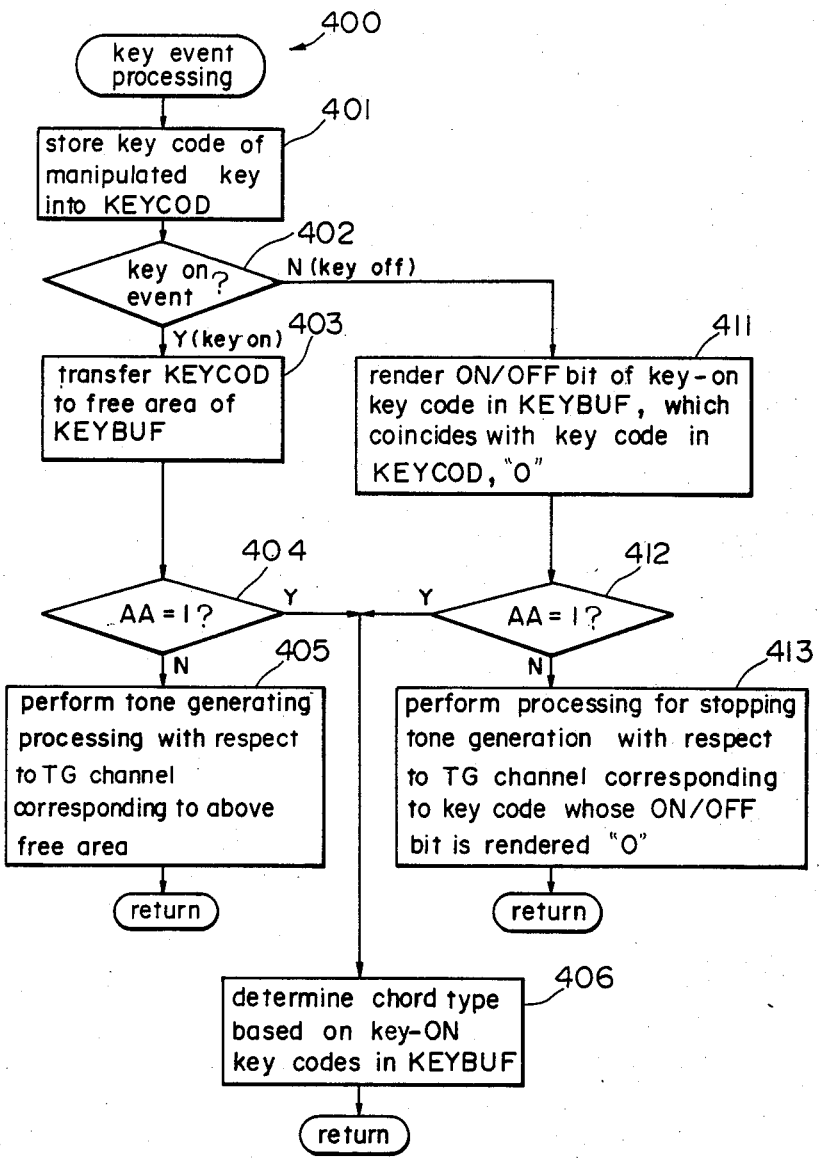
FIG. 11 is a flow chart of the key event processing performed by the CPU 107.

The key event processing performed at the step 400 of FIG. 5 will now be described with reference to a flow chart shown in FIG. 11.

At step 401, the CPU 107 reads the key information of the manipulated key from the key encoder 103 and stores it into the key code buffer KEYCOD. Then, the CPU 107 determines whether the manipulation or event was a depression of key (key ON event) or a release of key (key OFF event) from the key information at the next step 402. If it is determined that the event was a key ON event, the CPU 107 transfers the key information from the key code buffer KEYCOD to a free area (byte) of the key buffer KEYBUF at the next step 403. Then, the processing proceeds to step 404 at which it is determined whether the automatic accompaniment flag AA is in the "1" state. If the determination result is "NO", the CPU 107 carries out a processing necessary for causing one of the tone signal generating channels of the circuit 113 which corresponds to the byte into which the key information was stored to begin to generate a tone signal represented by the key code of the stored key information. Thus, a tone signal corresponding to the key actually depressed on the keyboard 102 is generated in this case. Then, the processing returns to the main processing. If it is determined at the step 404 that the automatic accompaniment flag AA is "1", a chord type is determined at step 406 in accordance with the key codes representative of the depressed keys stored in the key buffer KEYBUF. The chord type has to be determined in advance since an accompaniment is produced by a tempo clock interrupt processing shown in FIG. 8 in accordance with the chord type and the rhythm pattern. Then, the processing returns from the step 406 to the main processing.

On the other hand, when it is determined at the step 402 that the event was a key OFF event, the CPU 107 searches at the next step 411 the key buffer KEYBUF for the key information which contains at its lower seven bits a key code identical to that in the key code buffer KEYCOD and contains at its most significant bit a key ON/OFF bit of "1". The CPU 107 then renders the key ON/OFF bit of the detected key information "0", thereby clearing the key information corresponding to the released key. At the next step 412, it is determined whether the automatic accompaniment flag AA is "1". If the determination result is "YES", then the processing proceeds to the step 406. On the other hand, if the determination result is "NO", the processing proceeds to step 413 at which the CPU 107 carries out a processing necessary for causing the tone signal generating channel which corresponds to the byte storing the key information whose key ON/OFF bit is changed from "1" to "0" to stop the generation of tone signal. Thus, the tone signal corresponding to the key released on the keyboard is decreased to zero. Then, the processing returns to the main processing.

(4) Tempo clock interrupt processing

Figure 12:
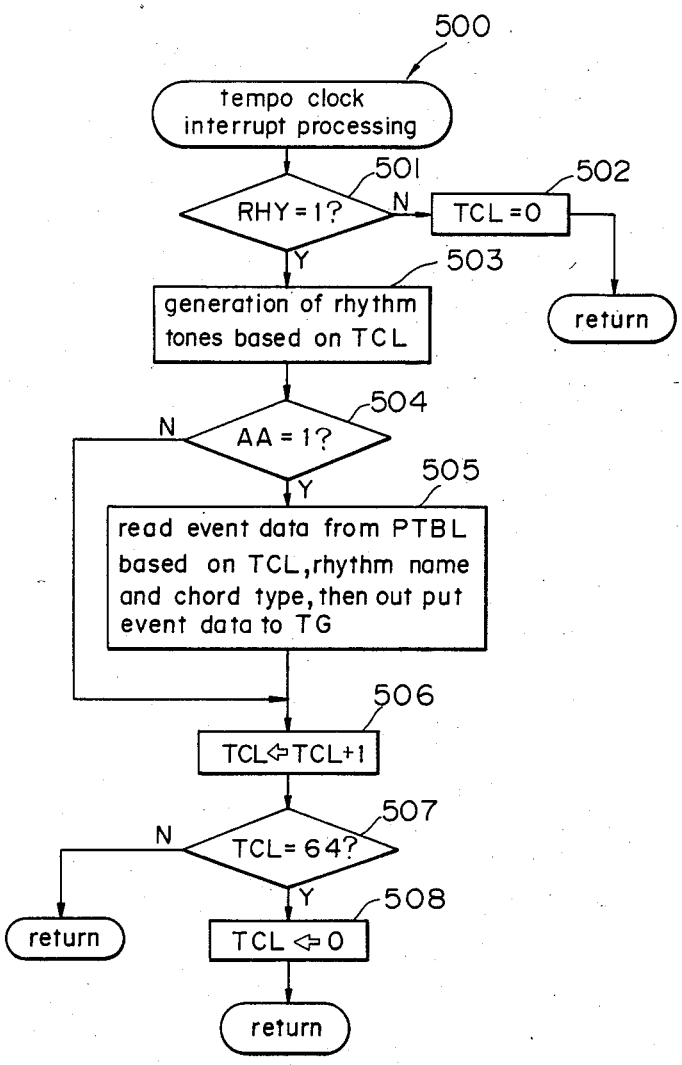
FIG. 12 is a flow chart of the tempo clock interrupt processing performed by the CPU 107.

In this electronic musical instrument 100, the tempo clock signal generated by the tempo clock generator 112 is used as an interrupt signal in response to which the CPU 107 carries out the tempo clock interrupt processing 500 shown in FIG. 12. When the tempo clock signal is outputted from the tempo clock generator 112, the CPU 107 begins to carry out the tempo clock interrupt processing at step 501. At this step 501, the CPU 107 determines whether the rhythm run flag RHY is in the "1" state. If the determination result is "NO", that is, if the auto rhythm system is not running, the CPU 107 clears the tempo counter TCL at step 502 and resets the interrupted state thereof. Then, the processing returns to the main processing.

On the other hand, if the result of the determination at the step 501 is "YES", that is, if the auto rhythm system is running, the processing proceeds to step 503 at which the CPU 107 carries out a processing for generating rhythm tones designated by the contents of the tempo counter TCL. At the next step 504, it is determined whether the automatic accompaniment flag AA is in the "1" state. If the determination result is "NO", the processing proceeds to step 506, in which case no accompaniment is generated. On the other hand, if the result of the determination at the step 504 is "YES", a processing for generating an accompaniment is carried out at step 505. More specifically, the CPU 107 selects one of the accompaniment patterns in the pattern table PTBL in accordance with the chord type and the rhythm name, reads the event data designated by the contents of the tempo counter TCL from the selected accompaniment chord pattern, and outputs the read event data to the tone signal generating circuit 113. Then, the processing proceeds to the next step 506.

At the step 506, the contents of the tempo counter TCL are incremented by one. Then, it is determined whether the contents of the tempo counter TCL has reached "64" at step 507. If the determination result is "NO", then the CPU 107 resets the interrupted state thereof and the processing returns to the main processing. On the other hand, if the result of the determination at the step 507 is "YES", then the contents of the tempo clock counter TCL is cleared at step 508, and the processing returns to the main processing.

Although the above embodiment is so arranged that one of four tone colors is selected, the embodiment can be modified to increase or decrease the number of selectable tone colors. Furthermore, an auto base system can be additionally provided in the above embodiment.

Thus, with the structure of the embodiment, when an accompaniment chord is played in accordance with the operation of the auto rhythm system, the tone color most suitable to the accompaniment chord is automatically selected without the need for a tone color selection switch and tone source for the accompaniment chord.

Another electronic musical instrument comprising an automatic accompaniment playing system provided in accordance with a second embodiment of the invention will now be described.

Figure 13:
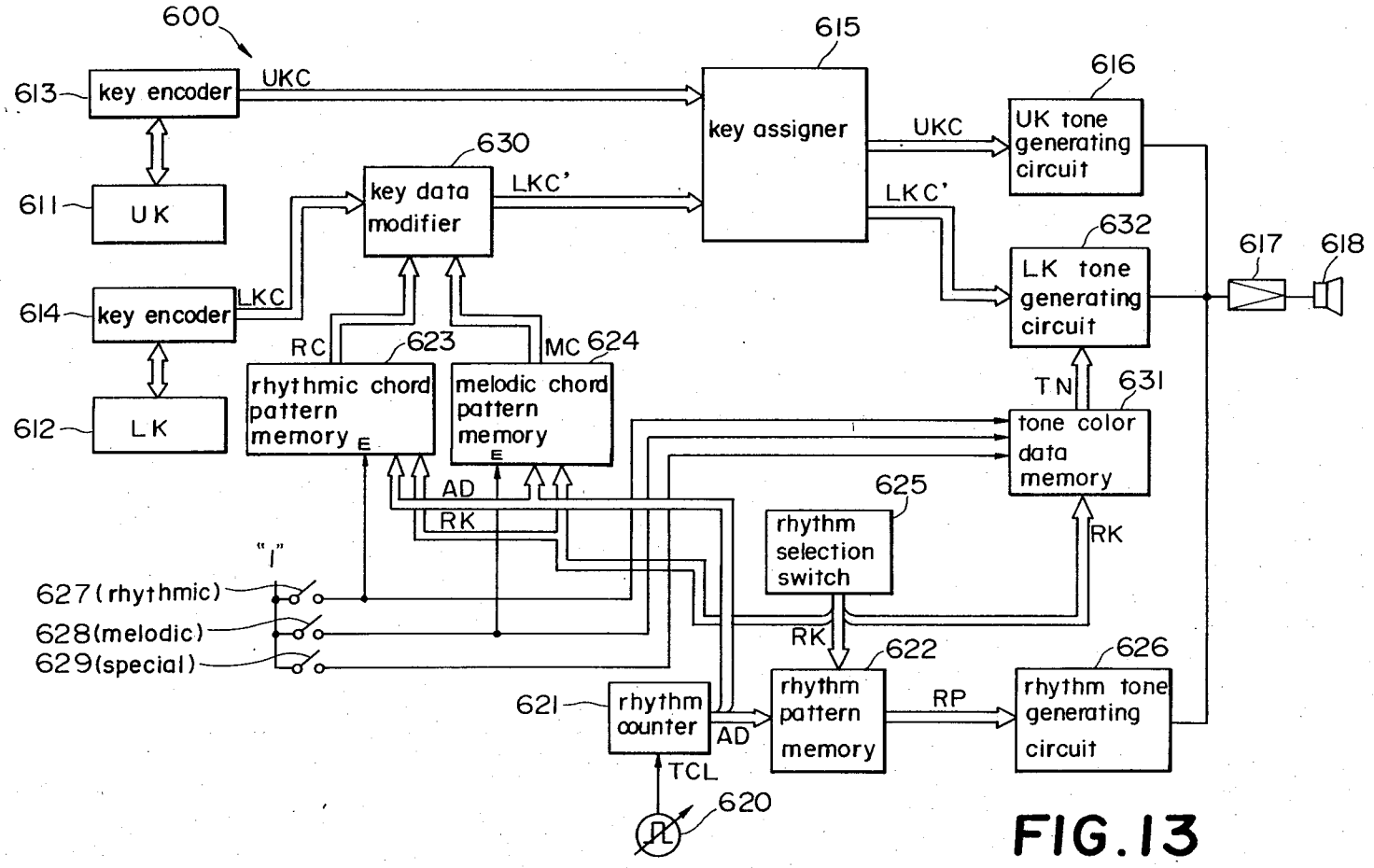
FIG. 13 is a block diagram of an electronic musical instrument comprising an automatic musical accompaniment playing system provided in accordance with a second embodiment of the invention.

FIG. 13 shows an electronic musical instrument 600 comprising an automatic musical accompaniment playing system provided in accordance with the present invention. The electronic musical instrument 600 comprises an upper keyboard 611 for playing a melody and a lower keyboard 612 for playing a musical accompaniment. The electronic musical instrument 600 may alternatively comprise a single keyboard, in which case the keyboard is divided into two key zones, wherein the higher key zone is used for playing a melody and the lower key zone is used for playing a musical accompaniment to the melody.

The upper keyboard 611 is electrically connected to a key encoder 613 which detects each depression of key on the upper keyboard 611 and outputs one or more melody key data UKC each representative of the depressed key. Similarly, the lower keyboard 612 is electrically connected to a key encoder 614 which detects each depression of key on the lower keyboard 612 and outputs one or more accompaniment key data LKC each representative of the depressed key. The accompaniment key data LKC is modified by a key data modifier 630, which will be described later, to generate key data LKC'. Each of the melody key data UKC, accompaniment key data LKC and modified key data LKC' includes a four-bit note code representative of a note name of the depressed key, a three-bit octave code representative of a key zone to which the depressed key belongs, and a one-bit keyboard identifying data which determines whether this key data is a melody key data or an accompaniment key data. Thus, each of the key data UKC, LKC and LKC' is composed of eight bits.

The melody key data UKC and the modified accompaniment key data LKC' are supplied to a key assigner 615. This key assigner 615 is so constructed as to assign the melody key data UKC and the modified accompaniment key data LKC' to tone generating channels provided in UK tone generating circuit 616 and LK tone generating circuit 632. More specifically, the UK tone generating circuit 616 comprises a plurality of tone generating channels, and the key assigner 615 assigns each of the melody key data UKC identified in accordance with their keyboard identifying data to one of the plurality of tone generating channels of the UK tone generating circuit 616. The LK tone generating circuit 632 also comprises a plurality of tone generating channels, and the key assigner 615 assigns each of the modified accompaniment key data LKC' identified in accordance with their keyboard identifying data to one of the plurality of tone generating channels of the LK tone generating circuit 632. The key encoders 613 and 614 and the key assigner 615 may be of the conventional types such as those disclosed in U.S. Pat. No. 3,882,751, Japanese Patent Application Laid-Open No. 49-84215, Japanese Patent Application Laid-Open No. 49-84216 and Japanese Patent Application Laid-Open No. 54-28614.

Each of the tone generating channels of the UK tone generating circuit 616 generates a tone signal having a pitch designated by the melody key data UKC assigned thereto and having a tone color selected by the performer through a UK-tone tone color selection switches (not shown) provided in this electronic musical instrument 600. The tone signals thus generated by the respective tone generating channels of the UK tone generating circuit 616 are mixed to form a melody tone signal which is amplified by an amplifier 617 and outputted as a melody sound from a loudspeaker 618.

Shown at 620 in FIG. 13 is a tempo clock generator which comprises a variable frequency oscillator and generates a tempo clock signal TCL of a frequency adjusted by the performer. The tempo clock signal TCL is supplied to a rhythm counter 621 which counts pulses of the tempo clock signal TCL and outputs the count result, as address data AD, to a rhythm pattern memory 622, a rhythmic chord pattern memory 623 and a melodic chord pattern memory 624.

The rhythm pattern memory 622 stores a plurality of groups of different rhythm pattern data RP each group containing data for determining kinds of percussive instruments used and for controlling timings of generation of tones of the percussive instruments. One of the plurality of groups of rhythm pattern data RP is selected by rhythm data RK outputted from a rhythm selection switch 625 provided on a console (not shown) of this electronic musical instrument 600 and representative of the selected rhythm name, and the rhythm pattern data RP of the selected group are sequentially read from the rhythm pattern memory 622 at a time interval determined by the period of the tempo clock signal TCL. The rhythm pattern data RP thus outputted from the rhythm pattern memory 622 are supplied to a rhythm tone generating circuit 626.

The rhythm tone generating circuit 626 generates a rhythm tone signal in response to the rhythm pattern data RP read from the rhythm pattern memory 622 and supplies the generated rhythm tone signal to the amplifier 617.

The rhythmic chord pattern memory 623 stores a plurality of groups of rhythmic chord data RC each group including data relating to generation of tones designated by the accompaniment key data LKC. One of the groups of rhythmic chord data RC is selected by the rhythm data RK fed from the rhythm selection switch 625 when a "1" signal is supplied to an enabling terminal E of the rhythmic chord pattern memory 623 from a rhythmic chord mode selection switch 627. And, the rhythmic chord data RC of the selected group are sequentially read from the rhythmic chord pattern memory 623 by the address data AD at a time interval determined by the period of the tempo clock signal TCL. The rhythmic chord mode switch 627 is mechanically connected to a melodic chord mode selection switch 628 and a special mode selection switch 629 so that only one of them is closed at a time. The melodic chord pattern memory 624 stores a plurality of groups of melodic chord data MC each group including data relating to selection and generation of tones designated by the accompaniment key data LKC. One of the groups of melodic chord data MC is selected by the rhythm data RK fed from the rhythm selection switch 625 when a "1" signal is supplied to an enabling terminal E of the melodic chord pattern memory 624 from the melodic mode selection switch 628. And, the melodic chord data MC of the selected group are sequentially read from the melodic chord pattern memory 624 by the address data AD at a time interval determined by the period of the tempo clock TCL. The rhythmic chord data RC and the melodic chord data MC are supplied to the key data modifier 630.

Figure 1:
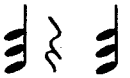
FIG. 1 is an illustration showing a series of notes representative of one example of a rhythmic chord.

When the rhythmic accompaniment mode is selected by closing the rhythmic chord mode selection switch 627, the key data modifier 630 outputs the accompaniment key data LKC fed from the key encoder 114 as the key data LKC' at intervals determined by the rhythmic chord data RC fed from the rhythm chord pattern memory 623 as shown, for example, in FIG. 1. When the melodic chord mode is selected by closing the melodic chord mode selection switch 628, the key data modifier 630 selects one or more of the accompaniment key data LKC fed from the key encoder 614 in accordance with the melodic chord data MC and outputs the selected key data LKC as the key data LKC' at intervals determined by the melodic chord data MC.

The mode selection switches 627 to 629 are also connected to a tone color data memory 631. The tone color data memory 631 stores a plurality of tone color data TN each representative of a tone color for tones of the musical accompaniment to be played, and one of the data TN which represents the tone color most suitable to the rhythm selected by the rhythm selection switch 625 is read from the tone color data memory 631 in accordance with the outputs of the mode selection switches 627 to 628 and the rhythm data RK fed from the rhythm selection switch 625. Thus, with the structure of this embodiment, the tone color of the tones of the musical accompaniment is selected in accordance with both of the type of rhythm and the type of accompaniment chord. The tone color data TN thus read from the tone color data memory 631 is supplied to the LK tone generating circuit 632.

Each of the tone generating channels of the LK tone generating circuit 632 generates a tone signal having a pitch determined by the key data LKC' assigned thereto by the key assigner 615 and having a tone color determined by the tone color data TN fed from the tone color data memory 631. One or more tone signals thus generated simultaneously by the tone generating channels of the LK tone generating circuit 632 are mixed to form an accompaniment tone signal. This accompaniment tone signal is combined with the melody tone signal from the UK tone generating circuit 616 and the rhythm tone signal from the rhythm tone generating circuit 626. The combined tone signals are amplified by the amplifier 617 and outputted as a sound from the loudspeaker 618.

The operation of the electronic musical instrument 600 will now be described.

When the rhythmic chord mode is selected by closing the rhythmic chord mode switch 627, the rhythmic chord pattern memory 623 is enabled to output rhythmic chord pattern data RC, and at the same time the tone color data TN representative of the tone color most suitable to the rhythmic chord is selected from those determined by the rhythm data RK and is read from the tone color data memory 631. The key data modifier 630 outputs three or four key data LKC, fed simultaneously from the key encoder 614 in accordance with depression of keys on the lower keyboard 612, simultaneously but intermittently at intervals determined by the rhythmic chord data RC from the rhythmic chord pattern memory 623. The tone generating channels of the LK tone generating circuit 632 generate tone signals corresponding respectively to the three or four keys depressed on the lower keyboard 612 with a tone color determined by the tone color data from the tone color data memory 631. As a result, the three or four tones are outputted from the loudspeaker 618, as shown in FIG. 1.

Figure 2:
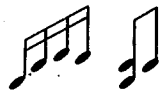
FIG. 2 is an illustration showing a series of notes representative of one example of a melodic chord.
Figure 3:
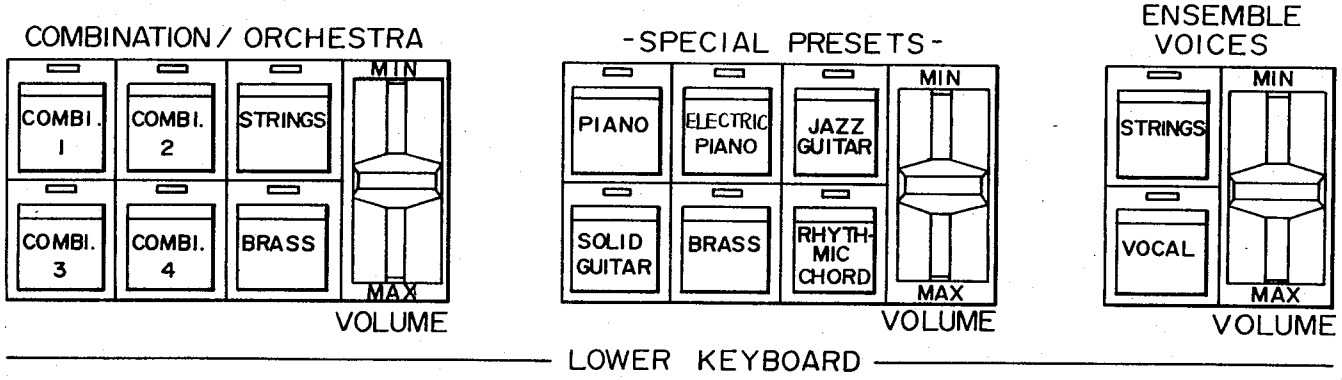
FIG. 3 (Prior Art)
FIG. 3 is an illustration showing a console of one conventional electronic musical instrument.
Figure 4:
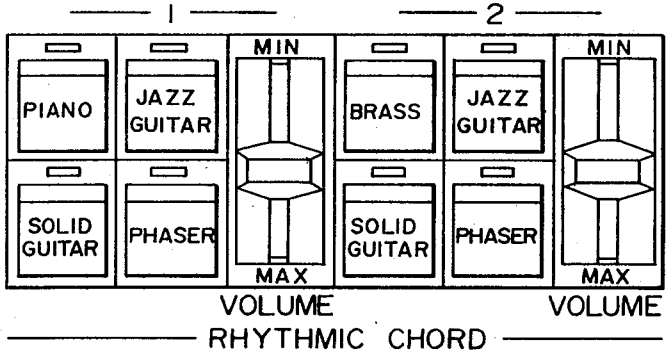
FIG. 4 (Prior Art)
FIG. 4 is an illustration showing a console of another conventional electric musical instrument.

When the melodic chord mode is selected by closing the melodic chord mode selection switch 628, the melodic chord pattern memory 624 is enabled to output melodic chord pattern data MC, and at the same time the tone color data TN representative of the tone color most suitable for the melodic chord is selected from those determined by the rhythm data RK and is read from the tone color data memory 631. The key data modifier 630 selects, in accordance with the melodic chord data MC from the melodic chord pattern memory 624, one or more of the three or four key data LKC fed simultaneously from the key encoder 614 in response to depression of keys on the lower keyboard 612, and outputs the selected key data LKC' at intervals determined by the melodic chord data MC from the melodic chord pattern memory 624. The tone generating channels of the LK tone generating circuit 632 generate, in response to the key data LKC', tone signals relating to the three or four keys depressed on the lower keyboard 612 with a tone color determined by the tone color data from the tone color data memory 631. In this case, one or more tone signals are generated at a time, so that the accompaniment tones are outputted from the loudspeaker 618, as shown in FIG. 2.

When the special mode is selected by closing the special mode switch 629, both of the rhythmic chord pattern memory 623 and the melodic chord pattern memory 624 are disabled from outputting data, so that the key data modifier 630 outputs the key data LKC fed from the key encoder 614 as the key data LKC' to the key assigner 615. On the other hand, the tone color data memory 631 outputs the tone color data TN designated only by the rhythm data RK. As a result, the tone generating channels of the LK tone generating circuit 632 generate tone signals corresponding respectively to the keys depressed on the lower keyboard 612 with a tone color selected by the rhythm selection switch 625. In other words, when the special mode is selected, this electronic musical instrument 600 operates in the normal playing mode.

With the aforesaid electronic musical instrument 600, the input of chord is performed in a fingered mode wherein each chord is inputted by depressing three or four keys constituting the chord on the lower keyboard 612. This electronic musical instrument 600 can be modified to operate in a single finger mode wherein each chord is inputted by depressing a single key on the lower keyboard 612 which corresponds to a root note of the chord, or by depressing a key corresponding to a root note of the chord together with other white and black keys wherein the combination of the depressed keys determines the type of the chord. In this case, the key data modifier 630 is modified to have a chord detection circuit for detecting a root note and a chord type from the key data LKC fed from the key encoder 614 and to form the key data LKC' based on the combination of the detected root note and chord type with one of the rhythmic chord pattern data RC and the melodic chord pattern data MC.

With the structure of the automatic musical accompaniment playing system in the electronic musical instrument 600, the tones of the accompaniment are automatically given a tone color most appropriate for the name of rhythm and the type of accompaniment chord.

What is claimed is:

1. An automatic musical accompaniment playing system for use in an electronic musical instrument having an auto rhythm system, said automatic musical accompaniment playing system comprising:

a tempo clock generator for generating clock pulses having a frequency proportional to a tempo of a rhythm to be generated by the auto rhythm system;

register means for storing state information indicative of a state of operation of the auto rhythm system;

counter means for counting said clock pulses in accordance with said state information;

tone color selecting means for selecting one of a plurality of tone colors;

detecting means for detecting a change of the operation of said tempo counter means in accordance with said state information to output a change detection signal;

tone color data generating means responsive to said selected tone color for generating as an output thereof first tone color data corresponding to said selected tone color when said detection signal is not outputted from said detecting means, said tone color data generating means generating as said output second tone color data corresponding to said selected tone color and different from said first tone color data in response to said change detection signal; and tone generating means operatively connected to said counter means for generating accompaniment tones having a tone color represented by said output from said tone color data generating means at timing based on a count value of said counter means;

whereby the tone color of said accompaniment tones is changed in accordance with the state of operation of said counter means.

2. An automatic musical accompaniment playing system according to claim 1, wherein said tone color data generating means comprising memory means having first and second storage areas each for storing a plurality of tone color data each corresponding to a tone color, one of said plurality of tone color data in said first storage area being read from said memory means as said first tone color data, one of said plurality of tone color data in said second storage area being read from said memory means as said second tone color data.

3. An automatic musical accompaniment playing system according to claim 1 further comprising:

a keyboard having a plurality of keys for playing an accompaniment;

key depression detection means for detecting each key depressed on said keyboard to output a key data representative of said depressed key; and chord detecting means for detecting a chord determined by said key data;

said tone generating means generating said accompaniment tones based on said detected chord.

4. An automatic musical accompaniment playing system for use in an electronic musical instrument comprising:

a tempo clock generator for generating clock pulses having a frequency proportional to a tempo of a rhythm to be generated;

counter means for counting said clock pulses;

rhythm selection means for selecting one of plural rhythms to output rhythm data representative of the selected rhythm;

rhythm pattern generating means responsive to said rhythm data for generating a rhythm pattern corresponding to said selected rhythm in accordance with a count value of said counter means;

rhythm tone generating means for generating rhythm tones at timing determined by said rhythm pattern;

accompaniment type selection means for selecting one of plural types of accompaniments to output type data representative of the selected accompaniment type;

accompaniment pattern generating means responsive to said type data for generating an accompaniment pattern in accordance with said count value of said counter means;

accompaniment tone data generating means responsive to said accompaniment pattern for generating accompaniment tone data representative of accompaniment tones;

tone color data generating means for generating tone color data representative of a tone color determined by said rhythm data and said type data, said tone color being suitable for said selected rhythm and said selected accompaniment type;

accompaniment tone generating means responsive to said accompaniment tone data for generating said accompaniment tones having said tone color at timing determined by said accompaniment pattern; and mixing means for mixing said accompaniment tones with said rhythm tones as an output of said automatic accompaniment playing system.

5. An automatic musical accompaniment playing system according to claim 4 further comprising chord data generating means for generating chord data representative of a chord, said accompaniment tone data representing a tone constituting said chord.

6. An automatic musical accompaniment playing system according to claim 5, wherein said plural types of accompaniments includes a rhythmic chord for intermittently generating all constituent tones of said chord at timing determined by said count value of said counter means and a melodic chord for selectively generating one or more of the constituent tones of said chord at timing determined by said count value of said counter means.

7. An automatic musical accompaniment playing system according to claim 6, wherein said plural types of accompaniments further includes a special accompaniment, said tone color data generating means generating said tone color data only in accordance with said data representative of the selected rhythm when said special accompaniment is selected.

* * * * *